US007322741B2

(12) United States Patent
Scheufele

(10) Patent No.: US 7,322,741 B2
(45) Date of Patent: Jan. 29, 2008

(54) SECOND HAND RESET DEVICE FOR A TIMEPIECE

(75) Inventor: Karl-Friedrich Scheufele, Promenthoux (CH)

(73) Assignee: Chopard Manufacture SA, Fleurier (CH)

( * ) Notice: Subject to any disclaimer, the term of this patent is extended or adjusted under 35 U.S.C. 154(b) by 0 days.

(21) Appl. No.: 11/727,017

(22) Filed: Mar. 23, 2007

(65) Prior Publication Data

US 2007/0230286 A1 Oct. 4, 2007

(30) Foreign Application Priority Data

Mar. 28, 2006 (EP) ..... 06006364

(51) Int. Cl.
*G04F 7/00* (2006.01)
*G04F 8/00* (2006.01)
*G04B 27/02* (2006.01)

(52) U.S. Cl. ..... 368/106; 368/112; 368/190

(58) Field of Classification Search ..... 368/106, 368/112, 185, 187, 190–199
See application file for complete search history.

(56) References Cited

U.S. PATENT DOCUMENTS 2,679,135 A * 5/1954 Hanhart ..... 368/103
3,667,212 A * 6/1972 Komiyama et al. ..... 368/106
3,690,058 A * 9/1972 Kurita ..... 368/204
3,762,153 A * 10/1973 Komiyama et al. ..... 368/187
4,022,013 A * 5/1977 Kamijo ..... 368/188
4,050,234 A * 9/1977 Toshio ..... 368/185
6,196,713 B1 3/2001 Meis et al.
6,252,827 B1 6/2001 Geyer

FOREIGN PATENT DOCUMENTS

| | | |
|---|---|---|
| DE | 30 24 165 A1 | 1/1982 |
| EP | 0 931 282 B1 | 7/1999 |
| FR | 2 771 192 A1 | 5/1999 |
| WO | WO 98/12609 | 3/1998 |

* cited by examiner

*Primary Examiner*—Vit W Miska
(74) *Attorney, Agent, or Firm*—Bacon & Thomas, PLLC

(57) ABSTRACT

A setting device for a timepiece comprising a second-indicating element (1) and at least one other time-indicating element comprises a first manual control element (2) that can occupy a neutral position and a position for setting the other time-indicating element or elements, and a mechanism (3) for resetting the second-indicating element (1) to zero, connected to the first manual control element (2). The reset mechanism (3) comprises a second manual control element (6) and is configured so that actuating the second manual control element (6) resets the second-indicating element (1) to zero when the first manual control element (2) is in the position for setting the other time-indicating element or elements and has no effect on the second-indicating element (1) when the first manual control element (2) is in the neutral position.

14 Claims, 3 Drawing Sheets

SECOND HAND RESET DEVICE FOR A TIMEPIECE

The present invention relates to a setting device for a timepiece, comprising a mechanism for resetting the second hand to zero.

A timepiece wherein the axial displacement of a manual control stem from a neutral position to a time-setting position stops the movement and automatically resets the second hand to zero is known from the documents EP 0 927 383 and EP 0 931 282.

The object of the present invention is to propose a setting device that is capable of resetting the second hand of a timepiece to zero when a manual control element is in a time-setting position, but wherein the second hand is only reset to zero if and when the user so desires.

To this end, the invention provides a setting device for a timepiece, the timepiece comprising a second-indicating element and at least one other time-indicating element, the setting device comprising a first manual control element that can occupy a neutral position and a position for setting the other time indicating element or elements and a mechanism for resetting the second-indicating element to zero, connected to the first manual control element, wherein the mechanism for resetting the second-indicating element to zero comprises a second manual control element and is configured so that actuating the second manual control element resets the second-indicating element to zero when the first manual control element is in the position for setting the other time-indicating element or elements and has no effect on the second-indicating element when the first manual control element is in the neutral position.

Specific embodiments of this device are defined in the appended dependent claims 2 to 13.

The present invention also proposes a timepiece, for example a wristwatch, comprising such a setting device.

Other features and advantages of the present invention will emerge from the following detailed description, given in reference to the attached drawings, in which.

Figure 1:
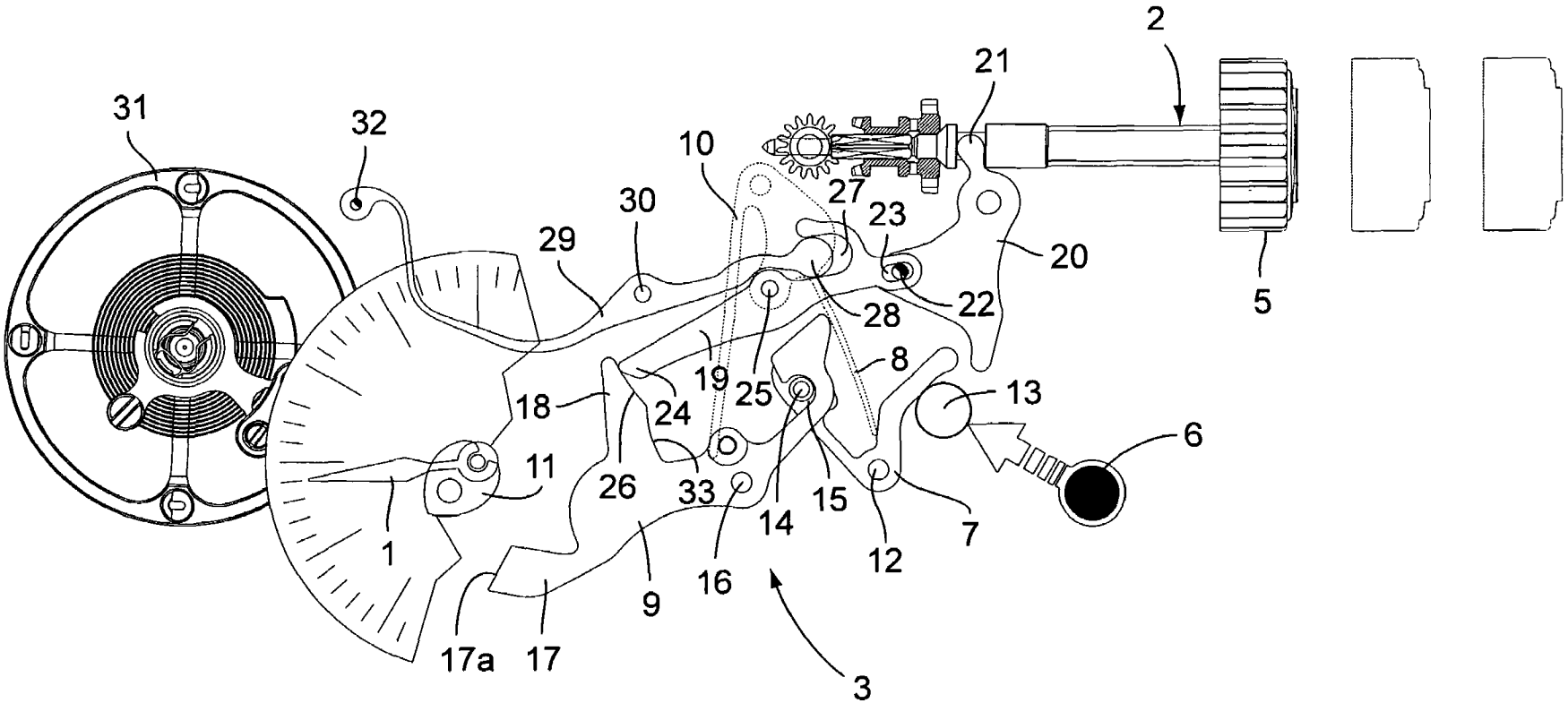
FIG. 1 is a top view of the setting device according to the invention in a configuration wherein a winding stem of the device is in a neutral position.
Figure 2:
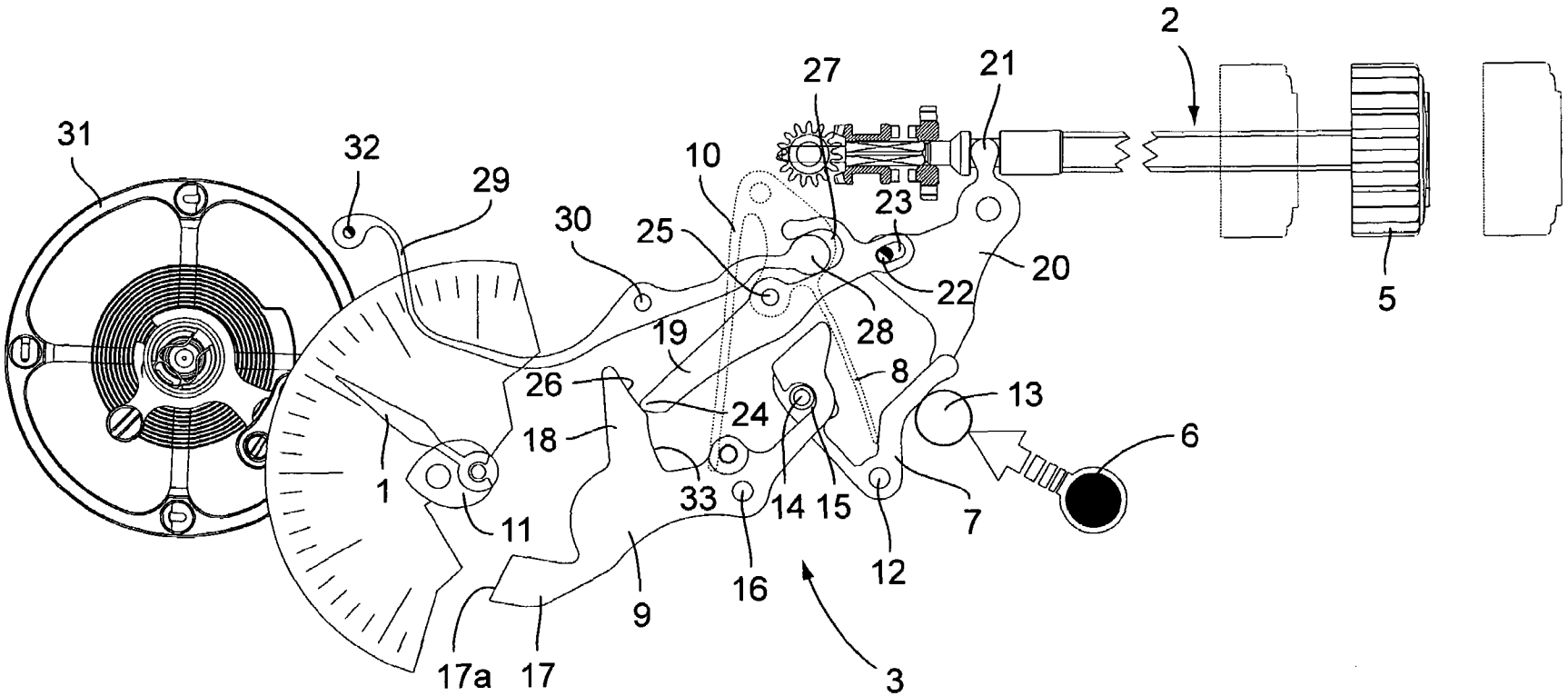
FIG. 2 is a top view of the setting device according to the invention in a configuration wherein the winding stem is in an intermediate pulled-out position.
Figure 3:
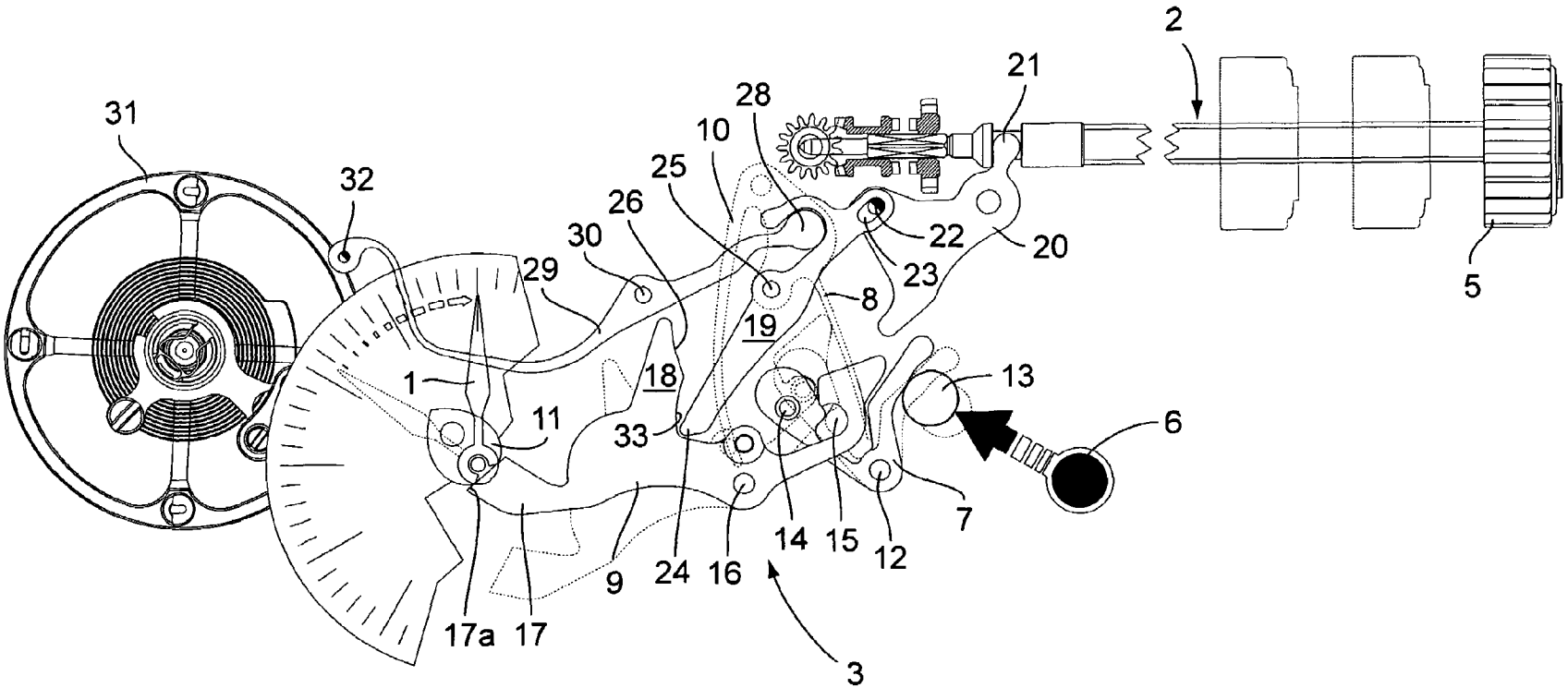
FIG. 3 is a top view of the setting device according to the invention in a configuration wherein the winding stem is in a fully pulled-out position.

FIGS. 1 through 3 represent a device according to the invention for setting a timepiece such as a wristwatch. The timepiece comprises central hour- and minute-indicating hands (not represented), and a small second-indicating hand 1 that is offset relative to the hour and minute hands. The setting device according to the invention comprises a first manual control element 2 and a mechanism 3 for resetting the second hand 1 to zero, connected to the first manual control element 2.

The first manual control element 2 is in the conventional form of a stem ending in a crown 5 that can be manipulated by a user. The stem 2, known as a winding or setting stem, can occupy three distinct axial positions, i.e., a neutral or winding position (FIG. 1), an intermediate pulled-out position for setting the date (FIG. 2), and a fully pulled-out position for setting the time (FIG. 3). In these three axial positions of the stem 2, the user can, by means of intrinsically known mechanisms that are not represented, respectively wind the mainspring of the timepiece, set a date display of the timepiece, and set the hour and minute hands by rotating the stem 2 around its axis.

The mechanism 3 for resetting the second hand 1 to zero comprises a second manual control element of the push button type, represented schematically by 6, an actuating rocker 7 subjected to the action of a spring 8, a hammer 9 subjected to the action of a spring 10, a heart-shaped cam 11 mounted on the shaft of the second hand 1 so as to be rigidly connected with the second hand 1, a second rocker 19 and a setting lever 20.

The actuating rocker 7 is angled at the level of its pivot 12 and has a first end that is maintained by the spring 8 in contact against a mobile post 13 controlled by the push button 6 and a second end that carries a cylindrical stud 14 which extends outside the plane of the drawing. The actuating rocker 7 can be pivoted from a rest position (FIGS. 1 and 2; FIG. 3: position indicated by a dotted line) to a reset actuating position (FIG. 3: position indicated by a solid line) by actuating the push button 6, which actuation translates the post 13 from its position indicated by a dotted line in FIG. 3 to its position indicated by a solid line, thereby pushing on the first end of the rocker 7. Once the pressure on the push button 6 is released, the actuating rocker 7 returns to its rest position under the action of the spring 8. In the rest position of the actuating rocker 7, the stud 14 is engaged in a U-shaped seat 15 with a semi-cylindrical bottom of appropriate size formed in one end of the hammer 9, thereby retaining the hammer 9 against the action exerted by the spring 10, which action tends to pivot the hammer 9 toward the heart-shaped cam 11 around a pivot 16. When the actuating rocker 7 is in its pivoted reset actuating position, the stud 14 is out of the seat 15 of the hammer 9 and no longer retains the latter.

On the other side of the pivot 16 from the seat 15, the hammer 9 is divided into two arms 17, 18. The first arm 17 comprises a striking surface 17*a* made to cooperate with the heart-shaped cam 11. The second arm 18 cooperates with the second rocker 19, as described below.

In an intrinsically known way, the setting lever 20 is in the form of a lever comprising a stud 21 seated in a groove of the winding stem 2. A pin 22 rigidly connected with the setting lever 20 is housed in an oblong hole 23 formed in one end of the rocker 19. The cooperation between the pin 22 and the hole 23 allows the setting lever 20 to pivot the rocker 19 as a function of the axial position of the winding stem 2. The rocker 19 can thus occupy three different angular positions, corresponding to the three axial positions of the winding stem 2. In its first two angular positions (FIGS. 1 and 2), which correspond to the neutral and date-setting positions of the winding stem 2, the rocker 19 cooperates, via an end 24 opposite its end that receives the pin 22 and located on the other side of its pivot 25, with a slightly concave stop surface 26 of the arm 18 of the hammer 9 so as to retain the hammer 9 against the action exerted by the spring 10, which action, as indicated above, tends to pivot the hammer 9 toward the heart-shaped cam 11. The stop face 26 has a profile forming an arc of a circle whose center, when the hammer 9 is retained by the rocker 19 (FIGS. 1 and 2), coincides with the pivot 25 of the rocker 19. Thus, the pivoting of the rocker 19 between its first two angular positions has no effect on the hammer 9, which remains prevented from pivoting toward the heart-shaped cam 11. In the third position of the rocker 19 (FIG. 3), which corresponds to the time-setting position of the stem 2, the end 24 of the rocker 19 is no longer in contact with the arm 18 and no longer prevents the hammer 9 from pivoting toward the heart-shaped cam 11.

On the same side of the pivot 25 as its end that receives the pin 22, the rocker 19 comprises a U-shaped seat 27 with a semi-cylindrical bottom into which is articulated a cylindrical end 28 of a stop lever 29. The pivoting of the rocker 19 from one of its positions to another causes the end 28 of the lever 29 to slide into the seat 27 and drives the lever 29 in a pivoting motion around its pivot 30. The lever 29 can thus occupy three different angular positions, corresponding to the three axial positions of the winding stem 2. In the two positions of the lever 29 that correspond to the neutral and date-setting positions of the stem 2 (FIGS. 1 and 2), the lever 29 is out of contact with the balance of the timepiece, designated by 31. In the third position of the lever 29, which corresponds to the time-setting position of the stem 2, a pin 32 rigidly connected with the end of the lever 29 opposite the end 28 is in contact with the periphery of the balance 31 and blocks the rotation of the latter.

The mechanism according to the invention works in the following way.

When the winding stem 2 is in its neutral position (FIG. 1), the end 24 of the rocker 19 is in contact with the stop surface 26 of the hammer 9 at a point located near the distal end of the arm 18, thus retaining the hammer 9 and preventing it from pivoting toward the heart-shaped cam 11. The pin 32 of the lever 29 is out of contact with the balance 31, which can therefore oscillate normally so as to allow the hour, minute and second hands to rotate. In this position of the stem 2, when the user presses the push button 6, the stud 14 of the actuating rocker 7 moves out of the seat 15 of the hammer 9, but this has no effect on the position of the hammer 9, which is retained by the rocker 19, and therefore no effect on the position of the second hand 1, which continues to rotate normally.

When the winding stem 2 is pulled from its neutral position to its intermediate date-setting position (FIG. 2), the end 24 of the rocker 19 slides on the stop surface 26 of the hammer 9 toward the proximal end of the arm 18 up to a determined point of this surface 26. The end 24 of the rocker 19 thus remains in contact with the arm 18, thereby retaining the hammer 9 and still preventing it from pivoting toward the heart-shaped cam 11. In the same time, the pin 32 of the lever 29 moves closer to the balance 31 but remains out of contact with this latter. The balance 31 can thus continue to oscillate normally so as to allow the hour, minute and second hands to rotate. In the intermediate date-setting position of the stem 2, when the user presses the push button 6, the stud 14 of the actuating rocker 7 moves out of the seat 15 of the hammer 9, but this has no effect on the position of the hammer 9, which is retained by the rocker 19, and therefore no effect on the position of the second hand 1, which continues to rotate normally.

When the winding stem 2 is pulled from its intermediate date-setting position into its outermost, time-setting position (FIG. 3), the pin 32 of the lever 29 comes into contact with the balance 31 so as to stop it, thus stopping the hour, minute and second hands. At the same time, the end 24 of the rocker 19 pivots toward the proximal end of the arm 18 of the hammer 9 and loses contact with the hammer 9 as soon as it moves away from the stop surface 26. The hammer 9 is then no longer retained by the rocker 19, but only by the stud 14 of the actuating rocker 7 seated in the seat 15. In the outermost, time-setting position of the stem 2, when the user presses the push button 6, the stud 14 moves out of the seat 15. No longer retained by the stud 14, the hammer 9, driven by the spring 10, then strikes the heart-shaped cam 11, which begins to rotate, sliding along the striking surface 17*a* of the hammer 9 until the base of the heart-shaped cam II is in contact with the striking surface 17*a*, thus resetting the second hand 1 to zero. This resetting of the second hand 1 to zero is made possible, in an intrinsically known way, by the fact that the second hand pinion and wheel, which engage with the movement train, are friction-mounted onto the shaft of the second hand 1, on which shaft the heart-shaped cam 11 and the second hand 1 are mounted.

After the second hand 1 is reset to zero, the hammer 9 is returned to its initial position by pushing the winding stem 2 from its outermost, time-setting position to its intermediate date-setting position. During this movement of the winding stem 2, the end 24 of the rocker 19 moves back toward the distal end of the arm 18, sliding along and pushing a slightly concave surface 33 of the arm 18 that is adjacent to the stop surface 26 and, more precisely, located between the proximal end of the arm 18 and the stop surface 26. The thrust that the end 24 of the rocker 19 exerts on the surface 33 raises the hammer 9 against the action of the spring 10 until the hammer 9 returns to its initial position in which the end 24 of the rocker 19 is in contact with the stop surface 26 and the stud 14 of the actuating rocker 7 in the rest position is in the seat 15. When the hammer 9 returns to its initial position, it causes the actuating rocker 7 to pivot by acting on the stud 14 so as to allow the stud 14 to be seated in the seat 15, i.e. to return to its initial position.

It is clear that, in the setting device as described above, the resetting of the second hand 1 to zero when the winding stem 2 is in its time-setting axial position does not occur automatically but on demand from the user, with a push on the push button 6. The user can thus decide whether resetting the second hand 1 to zero or not. The user can also decide when the second hand I will be reset to zero, for example after the setting of the hour and minute hands. Moreover, the function for resetting the second hand 1 to zero remains linked to the axial position of the winding stem 2, thus making it possible, for example, to allow the second hand 1 to be reset to zero only when the winding stem 2 is in its time-setting position.

The invention claimed is:

1. Setting device for a timepiece, the timepiece comprising a second-indicating element and at least one other time-indicating element or elements, the setting device comprising a first manual control element that can occupy a neutral position and a position for setting the other time indicating element or elements and a mechanism for resetting the second-indicating element to zero, connected to the first manual control element, wherein the mechanism for resetting the second-indicating element to zero comprises a second manual control element and is configured so that actuating the second manual control element resets the second-indicating element to zero when the first manual control element is in the position for setting the other time-indicating element or elements and has no effect on the second-indicating element when the first manual control element is in the neutral position.

2. Setting device according to claim 1, wherein the mechanism for resetting the second-indicating element to zero comprises a cam made to be rigidly connected with the second-indicating element, a hammer subjected to the action of a first spring which tends to move the hammer toward the cam, a first retaining element which retains the hammer against the action of the first spring when the second manual control element is not actuated and which does not retain the hammer when the second manual control element is actuated, and a second retaining element which retains the hammer against the action of the first spring when the first manual control element is in the neutral position and which does not retain the hammer when the first manual control element is in the position for setting the other time-indicating element or elements.

3. Setting device according to claim 2, wherein the first retaining element is a first rocker that can be pivoted against the action of a second spring by actuating the second manual control element, this first rocker comprising a stud which is disposed in a seat of the hammer so as to retain the hammer when the second manual control element is not actuated and is out of the seat when the second manual control element is actuated.

4. Setting device according to claim 2, wherein the second retaining element is a second rocker whose angular position depends on the position of the first manual control element, and one end of this second rocker cooperates with a stop surface of the hammer so as to retain the hammer when the first manual control element is in its neutral position and is out of contact with the stop surface when the first manual control element is in its position for setting the other time-indicating element or elements.

5. Setting device according to claim 4, wherein the stop surface has a profile substantially forming an arc of a circle whose center coincides with the pivot of the second rocker when the hammer is retained by the second rocker.

6. Setting device according to claim 5, wherein the first manual control element can occupy an intermediate position between the neutral position and the position for setting the other time-indicating element or elements, and in this intermediate position of the first manual control element, the end of the second rocker is in contact with the stop surface so as to retain the hammer.

7. Setting device according to claim 6, wherein the intermediate position of the first manual control element is a date-setting position.

8. Setting device according to claim 4, wherein the reset mechanism is configured so that after the second-indicating element is reset to zero, the end of the second rocker cooperates with a second surface of the hammer, adjacent to the stop surface, during a movement of the first manual control element from the position for setting the other time-indicating element or elements to the neutral position so as to return the hammer to its initial position.

9. Setting device according to claim 4, further comprising a first lever actuated by the second rocker so as to stop a balance of the timepiece when the first manual control element is in the position for setting the other time-indicating element or elements.

10. Setting device according to claim 4, wherein the first manual control element is a stem that is axially movable between the neutral position and the position for setting the other time-indicating element or elements, and a second lever comprising a stud engaged in a groove of the stem is also provided, this second lever controlling the second rocker.

11. Setting device according to claim 2, wherein the cam is heart-shaped.

12. Setting device according to claim 1, wherein the first manual control element is a stem that is axially movable between the neutral position and the position for setting the other time-indicating element or elements and the second manual control element is a push button.

13. Setting device according to claim 1, wherein the other time-indicating elements comprise hour- and minute-indicating hands, and the second-indicating element is a small hand, offset relative to the hour and minute hands.

14. Timepiece comprising a setting device according to claim 1.

* * * * *